US010182633B1

(12) United States Patent
Giovanni

(10) Patent No.: US 10,182,633 B1
(45) Date of Patent: Jan. 22, 2019

(54) LUGGAGE PROTECTION DEVICE

(71) Applicant: Katheryn Giovanni, Kingsland, GA (US)

(72) Inventor: Katheryn Giovanni, Kingsland, GA (US)

( * ) Notice: Subject to any disclaimer, the term of this patent is extended or adjusted under 35 U.S.C. 154(b) by 0 days.

(21) Appl. No.: 15/657,247

(22) Filed: Jul. 24, 2017

(51) Int. Cl.
*A45C 5/14* (2006.01)
*A45C 13/36* (2006.01)
*A45C 3/00* (2006.01)
*A45C 13/18* (2006.01)

(52) U.S. Cl.
CPC ..... *A45C 13/36* (2013.01); *A45C 3/001* (2013.01); *A45C 13/18* (2013.01); *A45C 5/14* (2013.01)

(58) Field of Classification Search
CPC ... A45C 5/14; A45C 13/262; A45C 2013/226; A45C 2013/267; A45C 5/146; A45C 7/0022
USPC ..... 190/112, 26, 101, 102, 901, 15.1, 18 R
See application file for complete search history.

(56) References Cited

U.S. PATENT DOCUMENTS 2,917,317 A * 12/1959 Denholm ..... A45C 5/146 190/18 A
3,946,839 A * 3/1976 Butler ..... A45C 5/146 190/102
2,711,234 A 6/1995 Rubens
5,875,876 A * 3/1999 Wang ..... A45C 5/14 150/111
7,077,251 B1 * 7/2006 Gaither ..... A45C 13/002 150/105
7,441,641 B2 10/2008 Beakey
9,004,119 B2 * 4/2015 Piper ..... A45C 3/08 150/105
2003/0164321 A1 * 9/2003 Ukitsu ..... A45C 7/0086 206/581
2004/0195791 A1 * 10/2004 Brookes-Inglis ..... A45C 5/14 280/47.26
2004/0221464 A1 * 11/2004 Burney ..... G01W 1/06 33/508
2011/0284334 A1 * 11/2011 Cheng ..... A45C 5/14 190/18 A
2013/0068355 A1 * 3/2013 Levy ..... A45C 3/08 150/105
2014/0060988 A1 * 3/2014 Lai ..... A45C 13/103 190/101
2017/0325556 A1 * 11/2017 Chickara ..... A45C 13/002

* cited by examiner

*Primary Examiner* — Sue A Weaver

(57) ABSTRACT

The luggage protection device is a suitcase aid especially welcomed by seasoned travelers, since suitcases are often subject to intentional and unintentional opening, and suitcase wheels are easy targets for damage, whether by bag handlers or by bag handling equipment. A closure cover guards zippers and the like against damage and opening, while a bottom cover guards wheels and bag bottoms. The bottom cover is provided in both a flexible design and a rigid design. Both designs are removable, and both can be fitted within a suitcase with little interior suitcase room required. A retractable wheel set is also offered as part of the device.

6 Claims, 7 Drawing Sheets

LUGGAGE PROTECTION DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Although luggage protection devices are known in the prior art, none have addressed the numerous common problems that often arise during the extended use of an article of luggage including, but not limited to, damage to zippers, clasps, and wheels. Unfortunately, such damage often compromises the security and structural integrity of the luggage itself. Thus, what has been needed is a luggage protection device having a flexible closure cover, at least one permanent fastener, at least one releasable fastener, and a flexible bottom cover. The luggage protection device is uniquely structured to enable a user to protect commonly damaged components of an article of luggage in order to extend the lifetime of the article of luggage and better secure the articles disposed inside the article of luggage itself.

FIELD OF THE INVENTION

The present suitcase protection device relates to luggage and luggage covers, and more particularly, to a luggage protection device that guards zippers, locks, and wheels.

SUMMARY OF THE NEWLY MANUFACTURED LUGGAGE AND ADD ON KIT FOR PRE-OWNED LUGGAGE

The general purpose of the luggage protection device, described subsequently in greater detail, is to provide a luggage protection device that has many novel features that result in a luggage protection device which is not anticipated, rendered obvious, suggested, or even implied by prior art, either alone or in combination thereof.

To accomplish this, for the pre-owned luggage, the luggage protection device includes a closure cover and a bottom cover. Depending upon user preference, the bottom cover is provided in slightly varied design, with a first design being flexible and a second design being rigid. The closure, typically used proximal a bag's handle, includes a flexible closure cover having a top end spaced apart from a bottom end, a left end spaced apart from a right end, and an outside opposite an underside. A user may choose a plurality of indicia disposed on the outside that ensures recognition of a suitcase in order to avoid a third party's wrongful claim of ownership to the suitcase. The indicia are provided on the closure cover. At least one permanent fastener attaches the top end to an existing bag having a bag top spaced apart from a bag bottom, a bag front spaced apart from a bag back, a bag left side spaced apart from a bag right side, a plurality of wheels disposed on the bag bottom, and a plurality of bag zippers and locks disposed on the bag top and the bag front. Depending upon the bag manufacturer, the bag front and the bag back are often interchangeably named and determined by the user. Many such bag descriptive terms denote a bag area that is expandable, with such compartments having zippers, clasps, locks, tags, and other features known in the art. Guarding such locks and zippers against intentional and unintentional opening is of considerable concern to countless travelers.

The luggage protection device further includes at least one releasable fastener that selectively affixes the bottom end to one of the bag front or the bag back. With the closure cover being partially permanently attached, use of the closure cover is convenient. With locks fitted, the closure cover optionally uses governmentally approved locks.

While the closure cover and the bottom cover are provided as aftermarket additions to existing bags, the newly manufactured luggage protection device is also provided with a retractable wheel set disposed within any bag bottom, whether original manufacturer included or fitted after manufacture of the bag. A retraction control is disposed on any bag bottom, the bag front, the bag back, the bag left side, and the bag right side. The retraction control is in control of an extension of the retractable wheel, locking them into place at the bag bottom, and a retraction of the retractable wheel set within the bag bottom. An extension release is disposed proximal the retraction control. The extension release controls an instant retraction of the retractable wheel set into the bag bottom.

One of a flexible bottom cover and a rigid bottom cover is as an add on kit for pre-owned luggage chosen by a user and can also be chosen by original luggage manufacturers. The bottom cover is provided permanently and removably disposed on each of the bag front, the bag back, the bag left side, the bag right side. The flexible bottom cover, which covers the wheels, can be removably disposed proximal the bag bottom. A constriction is selectively disposed within the flexible bottom cover, such as an elastic or a drawstring closure. The constriction selectively holds the bottom cover to the existing bag proximal the bag bottom. Both bottom covers provided are space efficient and easily stored within the suitcase when not in use, with the flexible bottom cover collapsing to a small area and the rigid bottom cover having the ability to be utilized as a container within the suitcase.

Thus has been broadly outlined the more important features of the present luggage protection device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
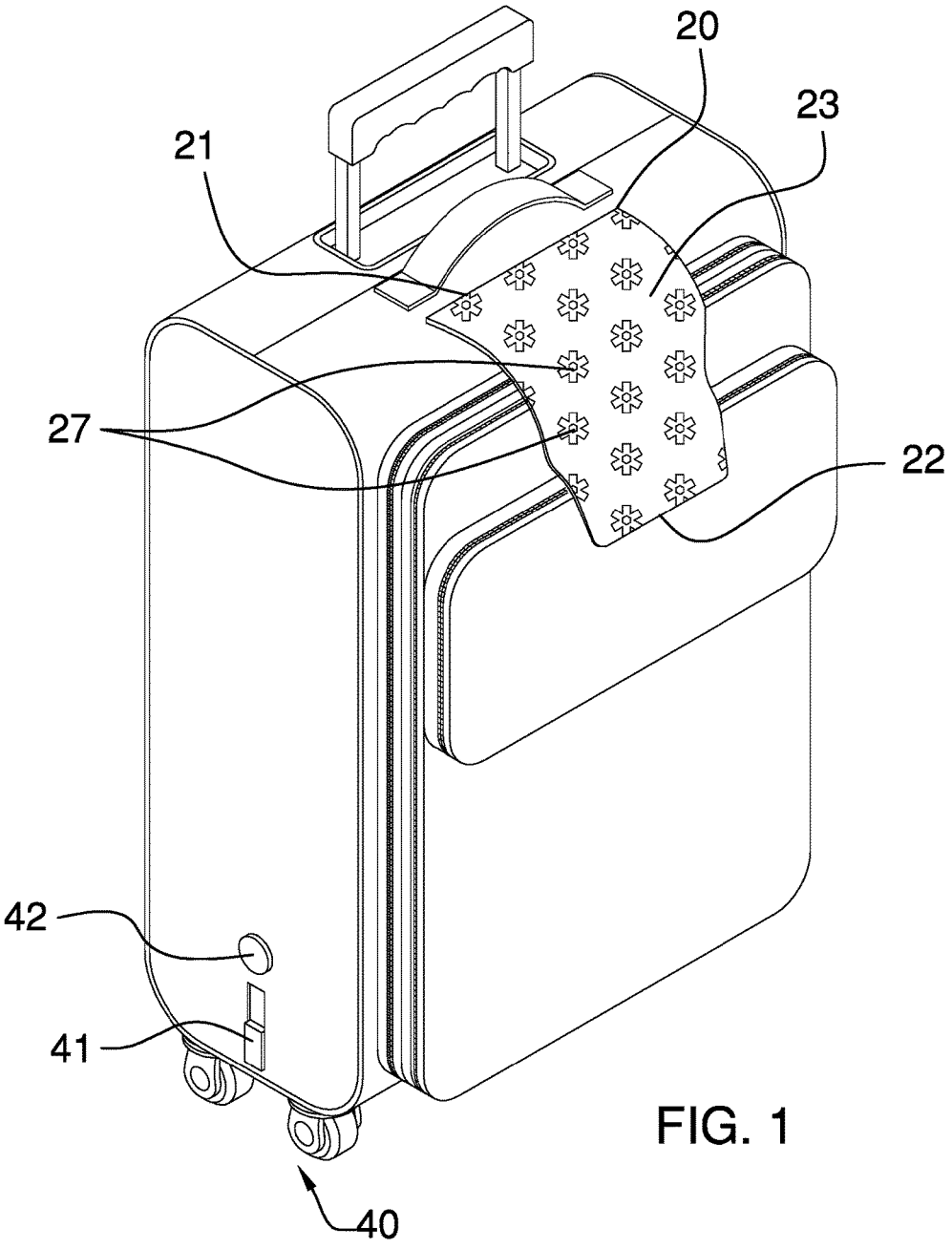
FIG. 1 is a perspective view of a closure cover of a suitcase protection device in use.
Figure 2:
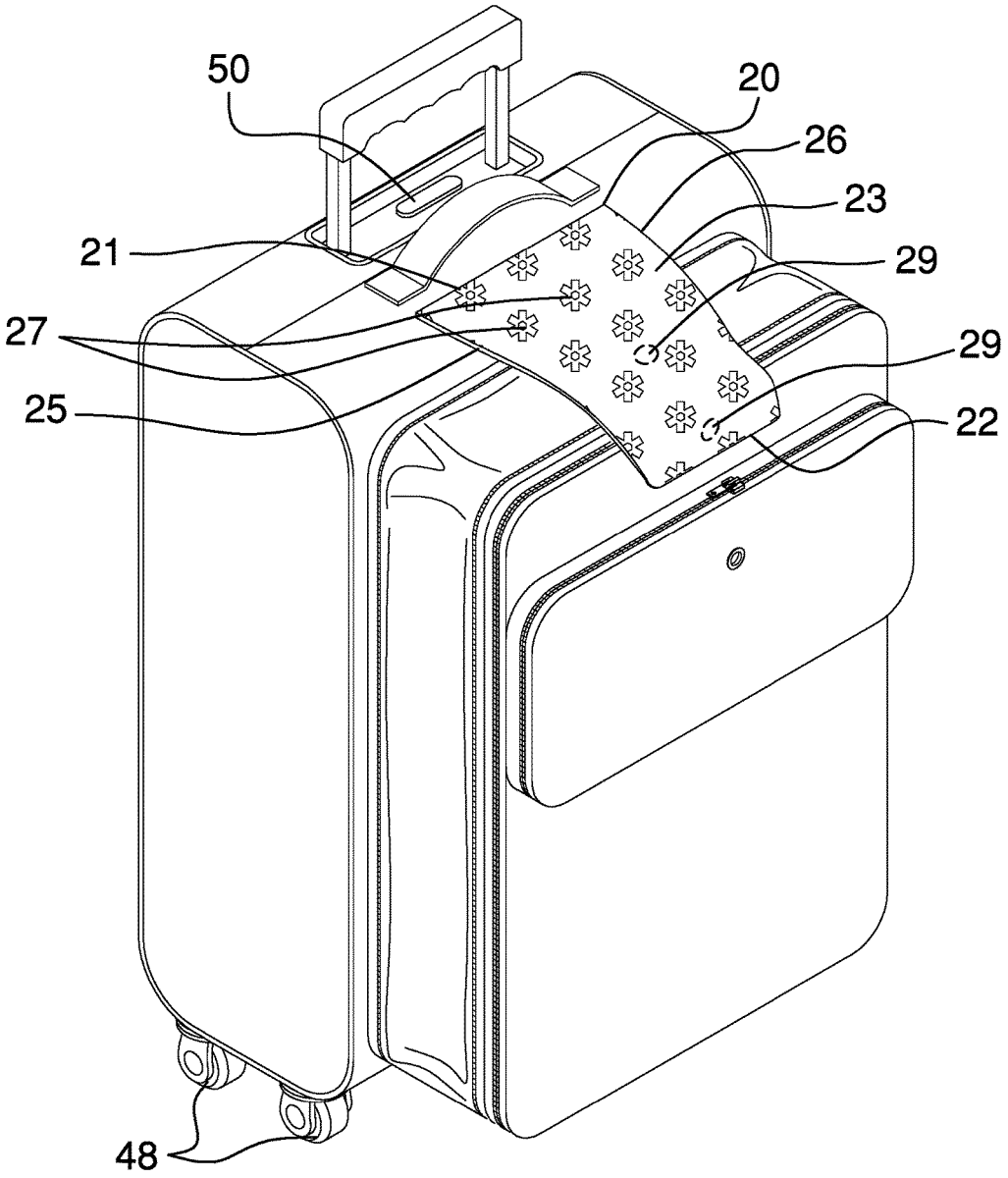
FIG. 2 is a perspective view of the closure cover in use on a fully expanded suitcase.
Figure 3:
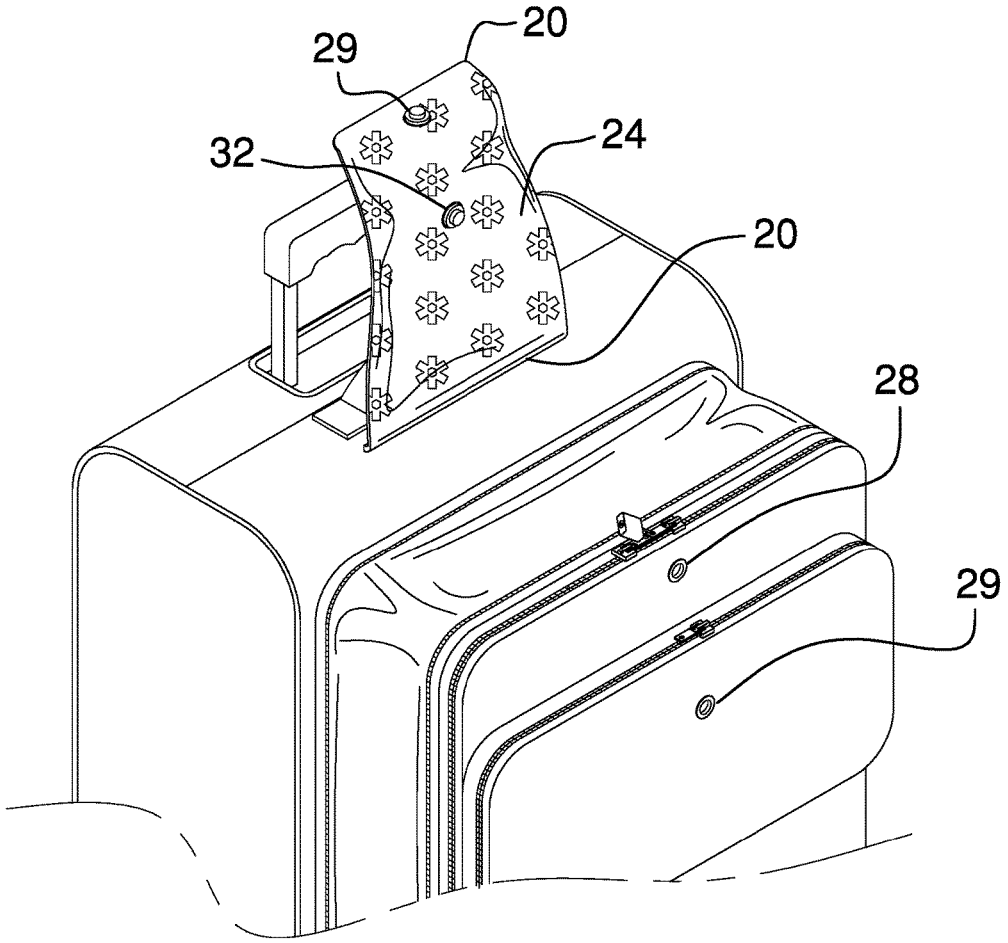
FIG. 3 is a perspective view of the suitcase protection device closure cover in use, with a plurality of releasable fasteners released.
Figure 4:
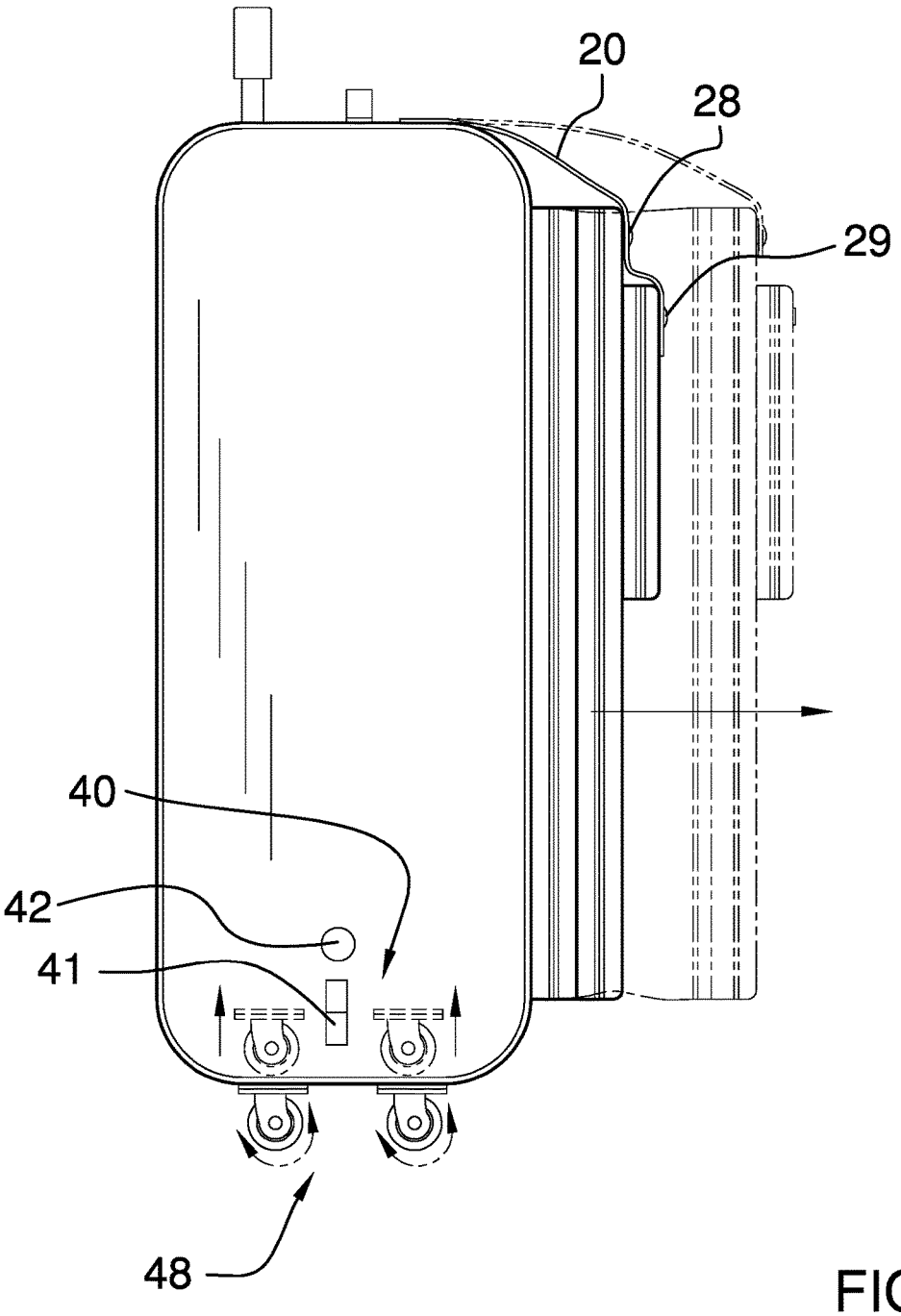
FIG. 4 is a lateral view of the closure cover of the suitcase protection device in use.
Figure 5:
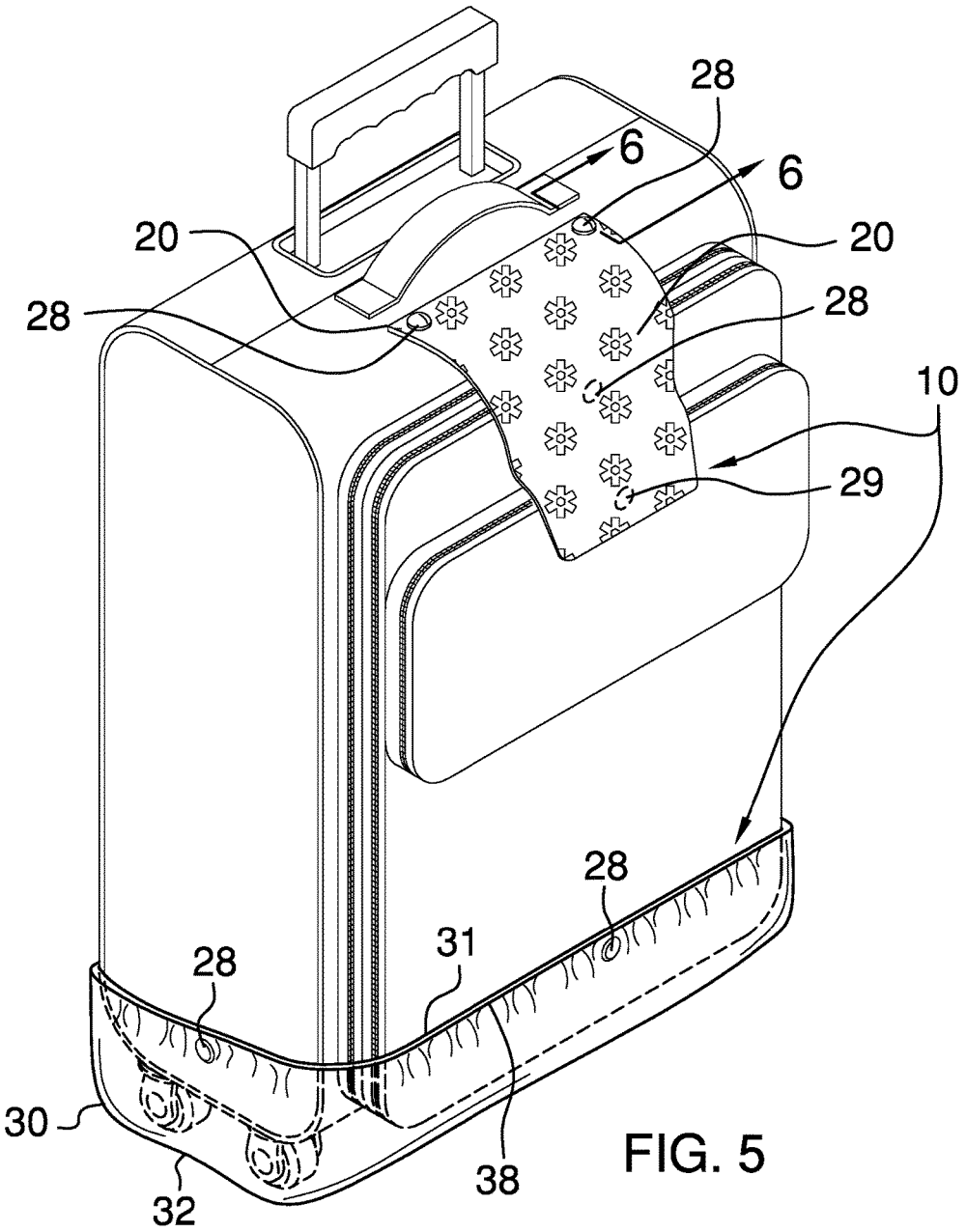
FIG. 5 is a perspective view of suitcase protection device in use, with a flexible bottom cover.
Figure 6:
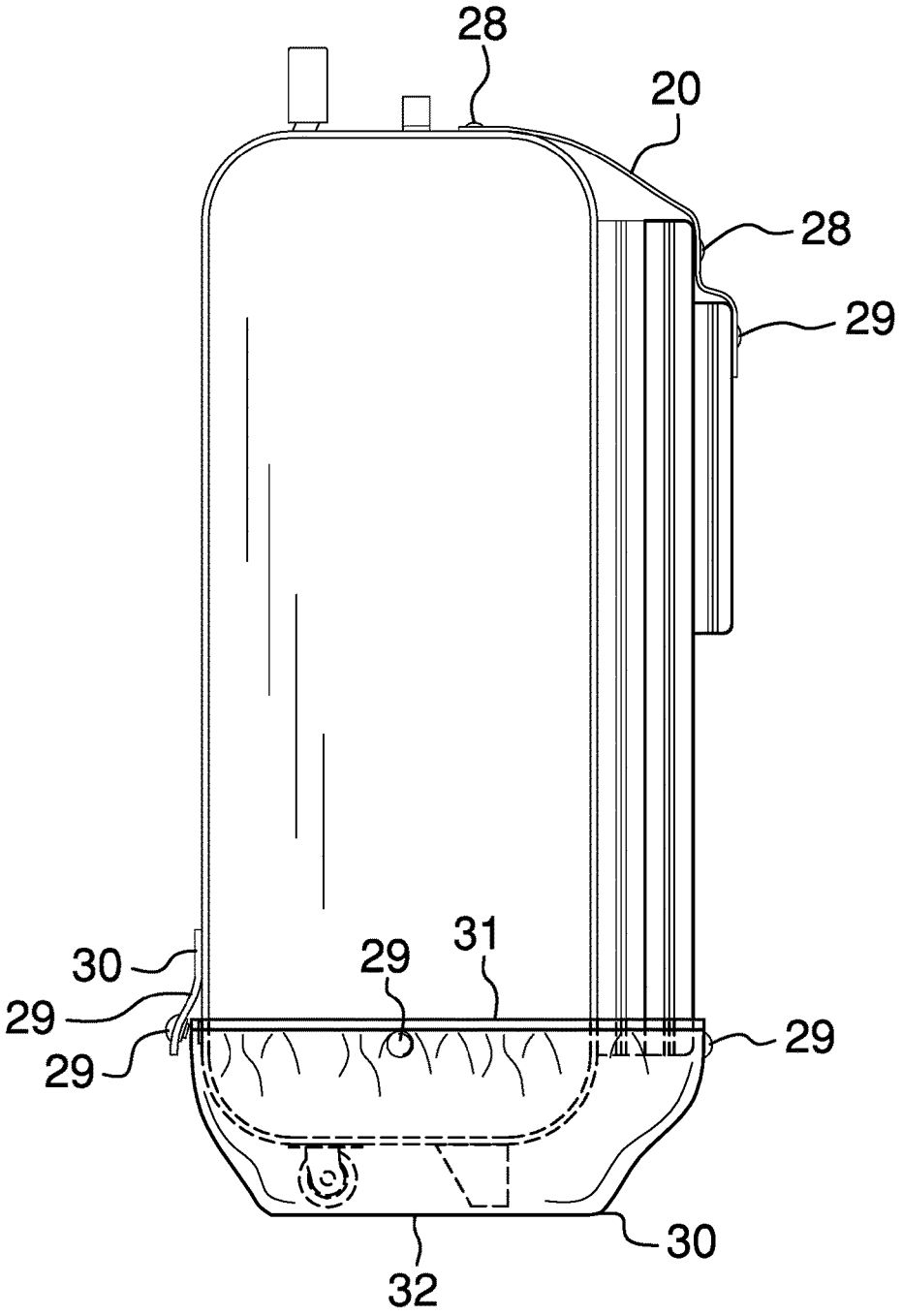
FIG. 6 is a lateral view of the luggage protection device with the closure cover and a rigid bottom cover in use.
Figure 7:
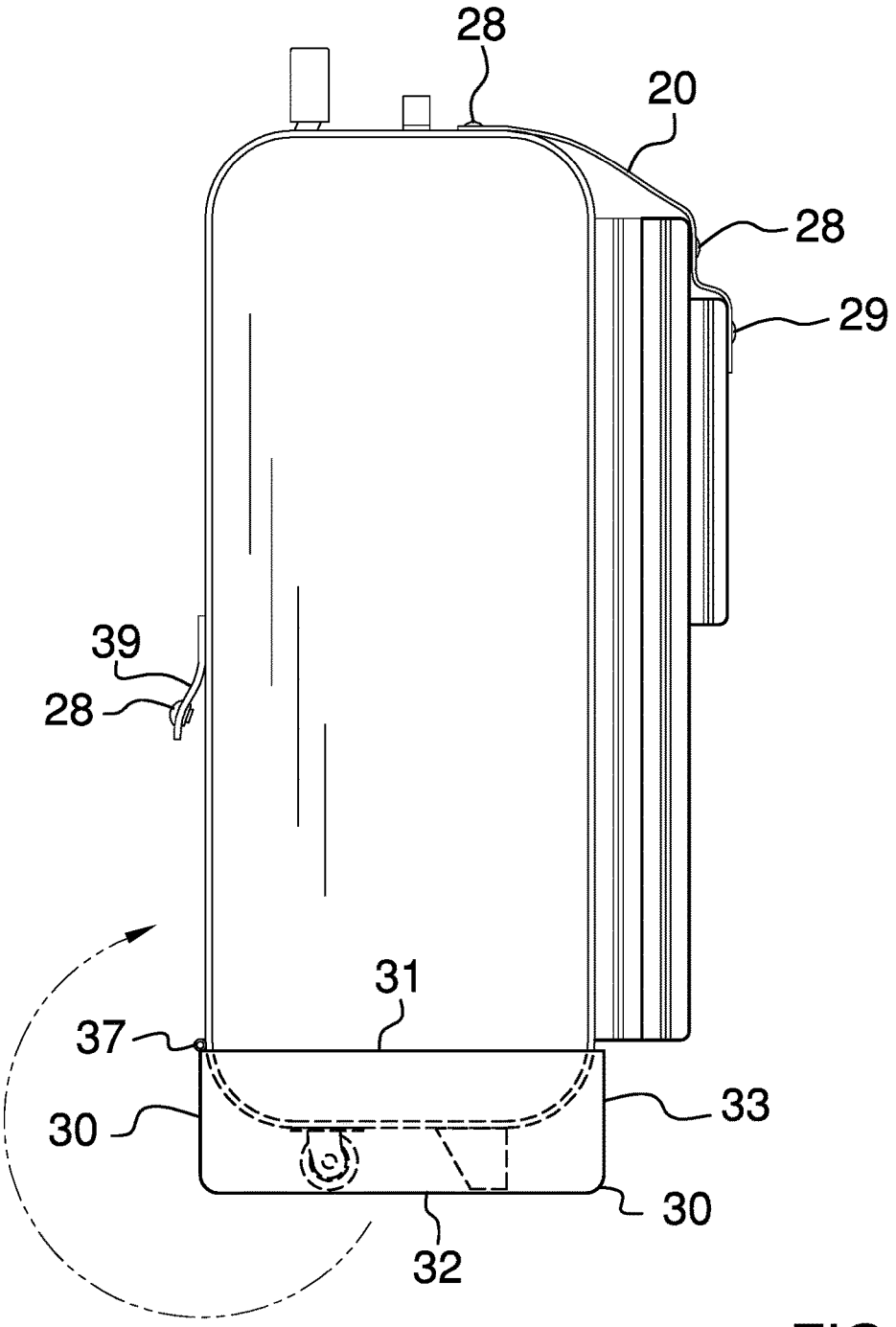
FIG. 7 is lateral view of the luggage protection device in use, with the rigid bottom cover that is pivotally attached.

With reference now to the drawings, and in particular FIGS. 1 through 7 thereof, an example of the luggage protection device employing the principles and concepts of the present luggage protection device and generally designated by the reference number 10 will be described.

Referring to FIGS. 1 through 7, the luggage protection device 10 includes a closure cover 20 and a bottom cover 30. The flexible closure cover 20 has a top end 21 spaced apart from a bottom end 22, a left end 25 spaced apart from a right end 26, and an outside 23 opposite an underside 24. A plurality of indicia 27 is disposed on the outside 23. At least one releasable fastener 28 attaches the top end 21 to an existing bag having a bag top spaced apart from a bag bottom, a bag front spaced apart from a bag back, a bag left side spaced apart from a bag right side. The closure cover 10 enables a user to cover a plurality of bag zippers and locks that are capable of closure near the bag top, thereby shielding the closures and locks from tampering and from accidental release.

A plurality of wheels is disposed on the bag bottom. A flexible bottom cover 40 is removably disposed on the bag front, the bag back, the bag left side, and the bag right side. The bottom cover 30 is removably disposed proximal the bag bottom and covers the wheels. A constriction 38 is selectively disposed within the top edge 31 of the flexible bottom cover 30. The constriction 38 selectively holds the bottom cover 30 to the existing bag proximal the existing bag bottom.

A rigid bottom cover 30 is optionally provided. Both the flexible bottom cover 30 and the rigid bottom cover 30 have a top edge 31 spaced apart from a bottom side 32, a front side 33 spaced apart from a back side 34, a left side 35 spaced apart from a right side 36. The rigid bottom cover 30 is removably disposed on the bag front, the bag back, the bag left side, the bag right side. The bottom covers 30 are removably disposed proximal the bag bottom and cover the wheels. A plurality of releasable fasteners 28 is disposed on the top edge 31 and proximal the bag bottom on each of the bag front, the bag back, the bag left side, the bag right side. At least one of the plurality of releasable fasteners 29 selectively affixes the bottom end 22 to the bag front. The rigid bottom cover 30 and the flexible bottom cover 30 are each provided as removably attached. The rigid bottom cover 30 is also provided in pivotal attachment. Additionally, the rigid bottom cover 30 can be used within the existing suitcase to hold any internal objects. Conversely, the rigid bottom cover 30 can be pivoted upwardly and secured on the bag back by a strap 39 and another releasable fastener 28, as shown.

While the closure cover 20 and the bottom cover 30 are provided as aftermarket additions to existing bags, the luggage protection device 10 is also provided with a retractable wheel set 40 disposed within any bag bottom, whether original manufacturer included or fitted after manufacture of the bag. A retraction control 41 is disposed on any of the bag bottom, the bag front, the bag back, the bag left side, and the bag right side. The retraction control 41 is in control of an extension of the retractable wheel set 40 without the bag bottom and a retraction of the retractable wheel set 40 within the bag bottom. An extension release 42 is disposed proximal the retraction control 41. The extension release 42 controls an instant retraction of the retractable wheel set 40 into the bag bottom. A second retraction control 50 is optionally provided on the bag top that allows for the selective extension and retraction of the retractable wheel set 40.

What is claimed is:

1. A luggage protection device comprising;

a flexible closure cover having a top end spaced apart from a bottom end, a left end spaced apart from a right end, an outside opposite an underside;

a plurality of indicia disposed on the outside;

at lease one permanent fastener attaching the top end to an existing bag having a bag top spaced apart from a bag bottom, a bag front spaced apart from a bag back, a bag left side spaced apart from a bag right side, a plurality of wheels disposed on the bag bottom, and a plurality of bag zippers and locks disposed on each of the bag top and the bag front;

a rigid bottom cover having a top edge spaced apart from a bottom side, a front side spaced apart from a back side, a left side spaced apart from a right side, the rigid bottom cover removably disposed on each of the bag front, the bag back, the bag left side, the bag right side, wherein the bottom cover is disposed proximal the bag bottom, wherein the bottom cover covers the wheels; and a plurality of releasable fasteners disposed on the top edge and proximal the bag bottom on each of the bag front, the bag back, the bag left side, the bag right side, wherein at least one of the plurality of releasable fasteners selectively affixes the bottom end to the bag front;

wherein a constriction selectively holds the bottom cover to the existing bag;

and wherein the closure cover selectively covers the bag zippers and locks.

2. The luggage protection device of claim 1 wherein the rigid bottom cover is removably attached.

3. The luggage protection device of claim 1 further comprising a strap having one of the plurality of releasable fasteners, wherein one of the plurality of releasable fasteners attaches the front side to the bag back, wherein the rigid bottom cover is pivotally attached.

4. A luggage protection device comprising:

a flexible closure cover having a top end spaced apart from a bottom end, a left end spaced apart from a right end, an outside opposite an underside;

a plurality of indicia disposed on the outside;

at lease one permanent fastener attaching the top end to an existing bag having a bag top spaced apart from a bag bottom, a bag front spaced apart from a bag back, a bag left side spaced apart from a bag right side, a plurality of wheels disposed on the bag bottom, and a plurality of bag zippers and locks disposed on each of the bag top and the bag front;

a retraction control disposed on one of the bag bottom, the bag front, the bag back, the bag left side, and the bag right side, wherein the retraction control is in control of an extension of the plurality of wheels within the bag bottom and a retraction of the plurality of wheels within the bag bottom;

and a retraction of the plurality of wheels within the bag bottom;

an extension release disposed proximal the retraction control, the extension release controlling an instant retraction of the plurality of wheels into the bag bottom;

at least one releasable fastener selectively affixing the bottom end to the bag front;

a rigid bottom cover having a top edge spaced apart from a bottom side, a front side spaced apart from a back side, a left side spaced apart from a right side, wherein the rigid bottom cover is removably disposed on the bag front, the bag back, the bag left side, and the bag right side, wherein the rigid bottom cover covers the bag bottom and the plurality of wheels; and a plurality of releasable fasteners disposed on the top edge proximal the bag bottom on each of the bag front, the bag back, the bag left side, and the bag right side;

wherein a constriction selectively holds the bottom cover to the existing bag;

and wherein the closure cover selectively covers the bag zippers and locks.

5. The luggage protection device of claim 4 wherein the rigid bottom cover is removably attached.

6. The luggage protection device of claim 4 further comprising a strap having one of the plurality of releasable fasteners, wherein one of the plurality of releasable fasteners attaches the front side to the bag back, wherein the rigid bottom cover is pivotally attached.

* * * * *